United States Patent [19]

Gruver, Jr.

[11] 4,321,656

[45] Mar. 23, 1982

[54] GASEOUS LANTERN VENTILATOR ASSEMBLY

[75] Inventor: Floyd O. Gruver, Jr., Wichita, Kans.

[73] Assignee: The Coleman Company, Inc., Wichita, Kans.

[21] Appl. No.: 171,709

[22] Filed: Jul. 24, 1980

[51] Int. Cl.[3] ..... F21L 19/00; F21L 19/04

[52] U.S. Cl. ..... 362/180; 362/159; 362/294; 362/314; 362/373

[58] Field of Search ..... 362/180, 159, 171, 294, 362/314, 373

[56] References Cited

U.S. PATENT DOCUMENTS 40,785 12/1863 Wellman ..... 362/315

2,015,432 9/1935 Metz ..... 362/180

*Primary Examiner*—Benjamin R. Padgett

*Assistant Examiner*—Irwin Gluck

*Attorney, Agent, or Firm*—Edward L. Brown, Jr.

[57] ABSTRACT

A gaseous lantern ventilator including an outer shell concentrically spaced over an inner metal liner which collects and exhausts the hot gases from the burner assembly through a chimney, the upper end of which is surrounded by an annular opening in the outer shell. The rising hot gases will entrain outside cool air drawn between the shell and liner, thereby cooling the liner and substantially reducing the surface temperature of the outside shell.

15 Claims, 4 Drawing Figures

FIG. 1
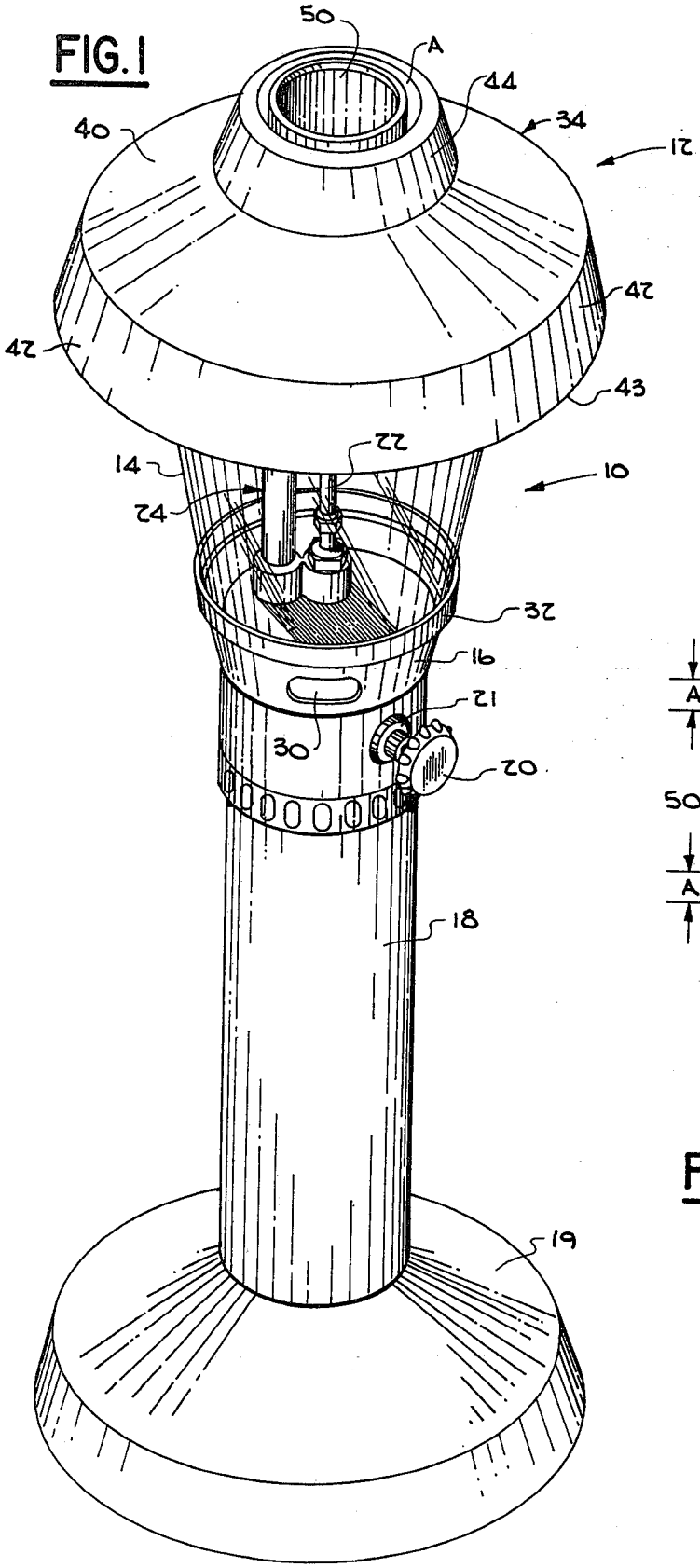
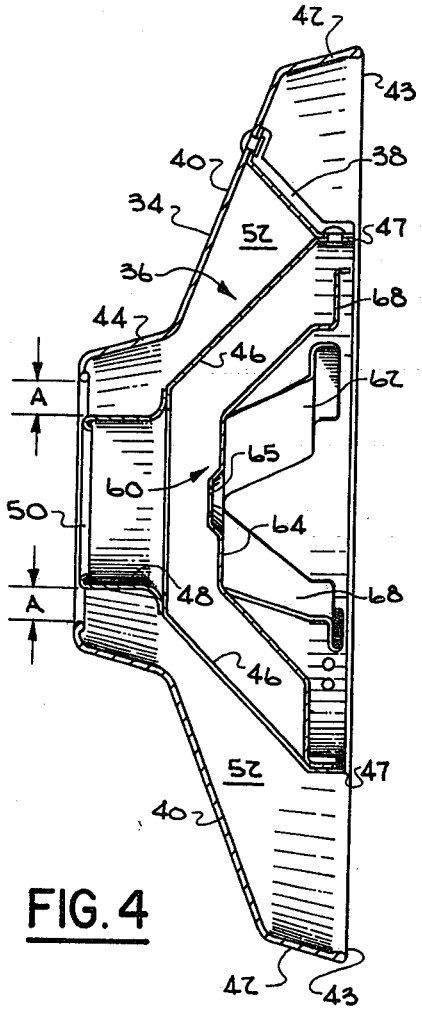
FIG. 4

GASEOUS LANTERN VENTILATOR ASSEMBLY

BACKGROUND OF THE INVENTION

The invention relates to gaseous fuel lanterns and more particularly to the ventilator structure of a propane lantern design to run with cooler surface temperatures.

In all gaseous fuel type lanterns a substantial amount of heat energy is released from the burning gases. This heat creates very high temperatures in the top of the lantern. Although all lantern designs ingest some outside air through the lantern, the ventilator or shade still runs at very high temperature levels, in the range of 300° to 500° Fahrenheit, and any human contact with the ventilator can cause serious burns.

DESCRIPTION OF THE PRIOR ART

The most pertinent prior art known to applicant is an 1863 U.S. Pat. No. 40,785. This patent teaches a lamp shade with a liner for preventing the paper shade from burning.

SUMMARY OF THE INVENTION

The invention is a composite ventilator structure including an inner metal liner separated from an outer shell with the liner and shell terminating in a pair of concentrically spaced chimneys. The hot gases rising up through the chimney of the liner from the burner assembly provide a lifting or entraining effect on those cooler gases exiting the concentrically spaced stack of the outer shell. The movement of this cooler air between the outer shell and liner has a substantial cooling effect on the liner, as well as the outer shell.

The principal object of the present invention is to provide a low temperature gaseous lantern ventilator assembly which can be touched by the human hand.

Another object of the present invention is to provide a gaseous lantern ventilator structure which allows the usage of plastics and other low temperature materials.

The advantages and objects of the invention will become evident from the following detailed description of the drawings when read in connection with the accompanying drawings which illustrate preferred embodiments of the invention.

BRIEF DESCRIPTION OF THE DRAWINGS

FIG. 1 is a perspective view of the ventilator assembly of the present invention on a base mounted propane lantern;

FIG. 4 is a vertical section through the ventilator assembly taken along the lines 4—4 of FIG. 3.

DESCRIPTION OF THE SPECIFIC EMBODIMENT

Figure 2:
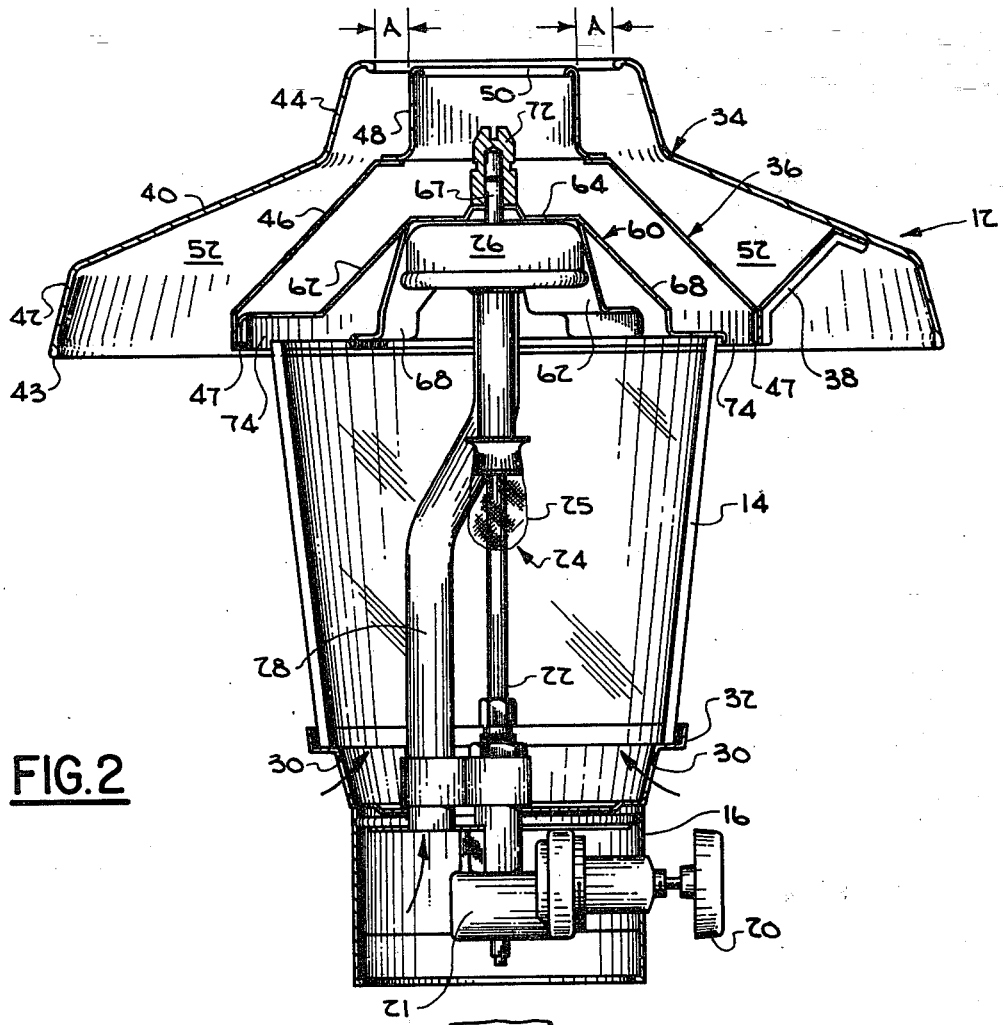
FIG. 2 is a vertical section through the lantern.

Referring now particularly to FIG. 1, the gaseous fuel lantern is generally described by reference numeral 10. The lantern includes a ventilator assembly 12, globe 14 which is supported upon the lamp frame 16, which in turn is carried by base member 18. The base includes a foot 19. The particular configuration shown in this figure is a patio type lantern wherein base member 18 is a hollow tube which receives a conventional propane bottle attached to the bottom of frame 16, not shown in the drawing. The particular details of the propane bottle and its connecting structure to the lantern are not shown in detail, since they are not a part of the present invention, but are described and illustrated in U.S. Pat. No. 3,941,554.

Adjusting knob 20 attached to a conventional pressure regulator valve 21 which supplies propane through a fuel tube 22 to a conventional burner assembly 24.

The burner assembly 24, shown in detail in FIG. 2, includes a mantle 25, gas generator 26, and air intake tube 28. Primary air enters the bottom of intake tube 28 from the bottom of frame 16 or around the annular opening in frame 16 surrounding valve 21. Secondary air enters openings 30 located around the periphery of frame 16. The upper end of fuel tube 22 extends through an offset portion of the air intake tube 28 through which fuel flows along with primary air into generator 26 before it is discharged and combusted at mantle 25. All of the burner structure above-mentioned is conventionally known structure in the art.

Positioned around the upper periphery of frame 16 is an upwardly extending shoulder 32 which supports the transparent lantern globe 14.

Figure 3:
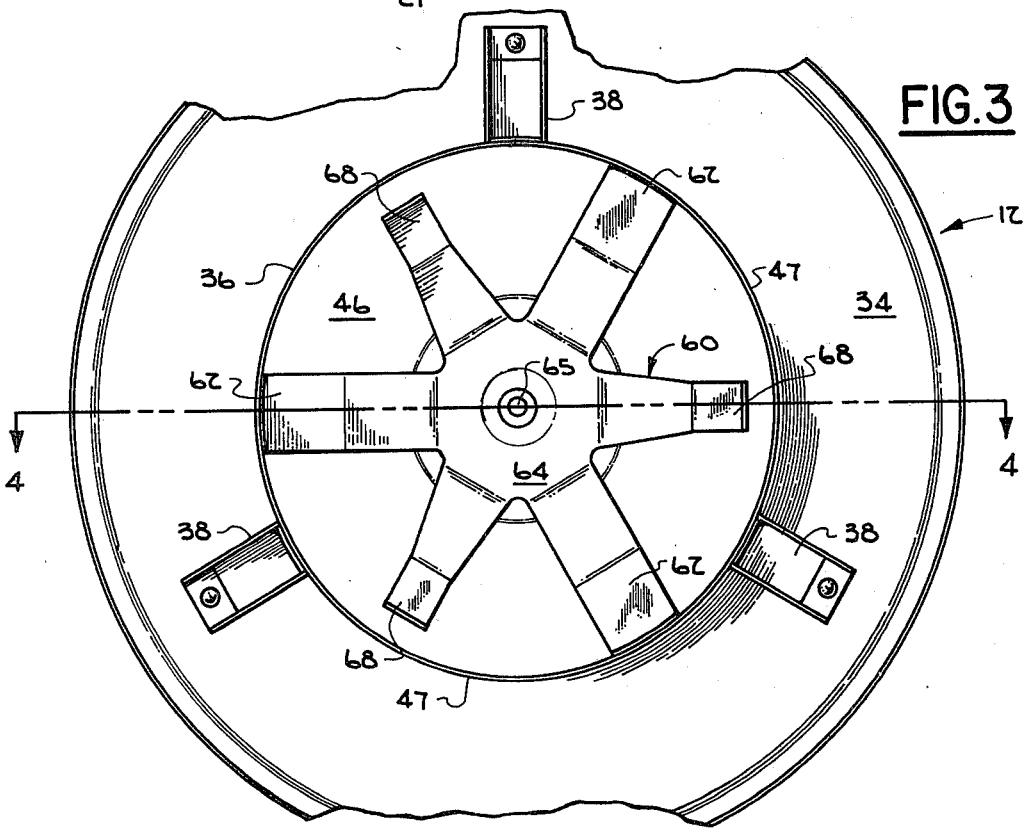
FIG. 3 is a bottom plan view of the ventilator assembly with portions broken away.

Ventilator assembly 12 includes an outer shell 34 concentrically spaced over a metal liner 36. Liner 36 is held in spaced relation to shell 34 by three connector members 38, as best seen in FIG. 3. Connectors 38 are riveted to both metal liner 36 and outer shell 34, the latter of which can be plastic.

Outer shell 34 includes a lower section 40 shaped as a conical frustum with a downwardly extending skirt 42 surrounding the periphery thereof, and an upper section 44 shaped as an open-ended stack 44. Liner 36 has a similar shape to shell 34 with a frustum lower section 46 terminating in a cylindrical chimney 48. Surrounding the open end 50 of chimney 48 is an annular opening A which lies in the same plane with chimney opening 50. Annular opening A opens a space 52 between the liner and shell which completely surrounds liner 36. At the bottom edge 43 of the ventilator assembly 12, space 52 has its widest cross sectional dimension for the entrance of outside air.

Concentrically located within liner 36 is a supporting bracket 60, as best seen in FIG. 3. Bracket 60 includes three alternate legs 62 which radiate outward from a center portion 64 and are attached to the liner 36. Legs 62 extend upwardly from the bottom edge 47 of the liner so that generator 26 extends well up into the ventilator 12. The conductive heat flow path from the burner assembly 24 is from generator 26 to bracket center portion 64 through the thin legs 62 to the liner 36. Alternately spaced between legs 62 are three additional legs 68 which rest on the top edge of globe 14, as can be seen in FIG. 2. Legs 68 not only align the ventilator 12 with the remaining lantern assembly, but also with a springing action hold the globe 14 firmly against the lantern frame 16 in its assembled condition. The center section 64 of the bracket includes an opening 65 for receipt of a mounting bolt 67 which is integrally attached to the upper end of burner assembly 24. Ventilator assembly 12 is removably held in place on the remaining lantern structure by a removable nut 72.

Surrounding the upper edge of globe 14, as seen in FIG. 2, there is a circumferential opening 74 between the globe and the lower edge of the liner 36, which admits cool outside air to the very hot gases of combustion which are rising from mantle 25 upwardly through chimney 48. Opening 74 allows the cool air to be drawn into the liner in a convective action which helps to minimize the surface temperature of the liner 36. The rising stream of hot gases which exits chimney 48 has an entraining effect upon the annular opening A which helps draw cool outside air up through space 52 located between the outer shell 34 and liner 36. This entrained air passing through space 52 substantially helps to reduce the surface temperatures of both liner 36 and outer shell 34.

As for example, with a conventional ventilator assembly, such as the one illustrated in the patent mentioned above, the surface temperatures at the lower outer edge of the ventilator and top of the ventilator are 350° and 550° Fahrenheit, respectively. In the ventilator structure of the present invention, the surface temperature at the outer edge 43 of shell 34 is 130° Fahrenheit, while the top surface of the shell adjacent opening A is 180° Fahrenheit.

With temperature reductions in the vicinity of 300° Fahrenheit, it is now possible to build a ventilator structure of plastic or other low temperature materials which have better insulative qualities. With the low temperature levels of the present design, it is possible to utilize gaseous fuel lanterns, gasoline or propane, in areas where there is a higher incidence of human contact, such as backyard patios.

The conductive heat flow path in the ventilator assembly provides a very efficient design. The high temperature burner assembly generator 26 contacts the center portion 64 of the bracket 60. The conductive flow path to the outer shell is first through thin legs 62 to the liner 36, and then on to outer shell 34 through connector members 38 which provide a very small cross sectional area and are located at a relatively cool position outwardly from the hot gases of combustion in the cool air flow path between the liner 36 and outer shell 34. The radiation heat transfer between liner 36 and outer shell 34 is also minimized by the movement of cool air through space 52 which cools the surface temperature of the liner.

The ventilator assembly would also have application on other types of fueled lamps, including gasoline, alcohol or any type of hydrocarbon, either liquid gaseous or semi-solid in state.

Changes may be made in the construction and arrangement of the parts or elements of the embodiments as disclosed herein without departing from the spirit or scope of the invention as defined in the following claims.

I claim:

1. In a hydrocarbon fuel lantern structure including a globe and burner assembly, the improvement comprising a ventilator assembly including:

an outer shell which is circular in shape converging upwardly toward an open end;

a liner concentrically spaced within the outer shell, defining an annular space therebetween, the liner having a circular shape converging upwardly and terminating in an open end which lies in a plane approximate to the plane of the open end of the outer shell;

bracket means on the liner supporting said ventilator assembly on the lantern globe and burner assembly; and connector means attaching the liner to said outer shell.

2. A hydrocarbon fuel lantern ventilator assembly as set forth in claim 1, wherein the outer shell and liner are shaped as a conical frustum.

3. A hydrocarbon fuel lantern ventilator assembly as set forth in claim 1, wherein the liner has a lower portion shaped as a conical frustum and an upper portion shaped as a chimney.

4. In a hydrocarbon fuel lantern structure including a globe and burner assembly, the improvement comprising a ventilator assembly including:

an outer shell with its lower section shaped as a conical frustum and the upper section shaped as an open-ended stack;

a liner concentrically spaced within the outer shell, defining a space therebetween, the upper portions of the liner being shaped as a chimney with its open end terminating in a plane approximate to the plane of the open end of the outer shell;

bracket means on the liner supporting said ventilator assembly on the lantern globe and burner assembly; and connector means attaching the liner to said outer shell.

5. A hydrocarbon fuel lantern ventilator assembly as set forth in claim 1, wherein the liner has a lower portion shaped as a conical frustum which terminates in a bottom edge.

6. A hydrocarbon fuel lantern ventilator assembly as set forth in claim 5, wherein the lower section of the outer shell includes a downwardly turned skirt surrounding its outer edge and terminating in a plane approximate to the plane of the bottom edge of said liner.

7. A hydrocarbon fuel lantern ventilator assembly as set forth in claim 1, wherein the bracket means comprises a plurality of legs radiating outwardly from the center thereof, the outer end of at least one leg being attached to the liner and the outer end of at least one other leg being supporting on said globe.

8. A hydrocarbon fuel lantern ventilator assembly as set forth in claim 1, wherein the bracket means comprises a plurality of legs radiating outwardly from a center portion, the outer ends of alternate legs being attached to the liner with the remaining legs being supported on said globe.

9. A hydrocarbon fuel lantern ventilator assembly as set forth in claim 1, wherein the bracket means comprises a plurality of legs radiating outwardly from a center portion, the outer ends of alternate legs being attached to the liner with the remaining legs contacting the lantern globe and the center portion of the bracket means being in contact with a portion of the burner assembly.

10. A hydrocarbon fuel lantern ventilator assembly as set forth in claim 1, wherein the bracket means comprises a plurality of thin legs radiating outwardly from a center portion, the end of at least one of said legs spring-biasing against the lantern globe whereby the globe is restrained against movement in the lantern structure.

11. A hydrocarbon fuel lantern ventilator assembly as set forth in claim 1, wherein the bracket means comprises a plurality of thin legs radiating outwardly from a center portion, the outer ends of alternate legs being attached to the liner with the remaining legs spring-biasing against the lantern globe whereby the globe is held against movement in the lantern structure.

12. A hydrocarbon fuel lantern ventilator assembly as set forth in claim 1, wherein said space between the outer shell and liner is annular in cross section with the cross sectional area decreasing from the bottom of the ventilator to the top opening of the stack adjacent the open end of the liner whereby convective currents rising through said space will be at a maximum velocity at their exit point of the ventilator.

13. A hydrocarbon fuel lantern including:

a burner assembly;

a globe positioned on the burner assembly;

a ventilator assembly positioned on the burner assembly and globe comprising:

an outer shell converging upwardly and terminating in an open end;

a liner concentrically spaced within the outer shell, defining a space therebetween, a portion of the liner being shaped as a chimney with its open end terminating in a plane approximate to the plane of the open end of the outer shell;

bracket means on the liner supporting said ventilator assembly on the lantern globe and burner assembly; and connector means attaching the liner to said outer shell.

14. In a hydrocarbon fueled lantern including a globe, a burner assembly and a ventilator assembly, the improved ventilator assembly including:

an outer shell with an open lower section and an open upper section, said open upper section comprising a substantially smaller area than said lower section;

a non-combustible liner surrounding the burner assembly, said liner being concentrically spaced within the outer shell defining a space sufficiently great therebetween to permit essentially free flow of air, the upper portions of the liner being shaped as a chimney with its open end terminating in a plane approximate to the plane of the upper open end of the outer shell;

bracket means on the liner supporting said ventilator assembly on the burner assembly and cooperating to maintain the position of the lantern globe; and connector means attaching the liner to said outer shell.

15. A hydrocarbon fuel lantern ventilator assembly as set forth in claim 14, wherein the connector means is attached to the liner approximate the lower section which is at a substantially lower temperature.

* * * * *